US010060332B2

(12) United States Patent
Sugimoto

(10) Patent No.: US 10,060,332 B2
(45) Date of Patent: Aug. 28, 2018

(54) COOLING APPARATUS FOR INTERNAL COMBUSTION ENGINE

(71) Applicant: Toyota Jidosha Kabushiki Kaisha, Toyota-shi Aichi-ken (JP)

(72) Inventor: Hitoki Sugimoto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 71 days.

(21) Appl. No.: 15/240,014

(22) Filed: Aug. 18, 2016

(65) Prior Publication Data

US 2017/0058756 A1 Mar. 2, 2017

(30) Foreign Application Priority Data

Aug. 27, 2015 (JP) ..... 2015-168044

(51) Int. Cl.

| | |
|---|---|
| ***F01P 11/14*** | (2006.01) |
| *F01P 5/12* | (2006.01) |
| *F01P 7/16* | (2006.01) |

(52) U.S. Cl.

CPC ..... *F01P 11/14* (2013.01); *F01P 5/12* (2013.01); *F01P 7/165* (2013.01); *F01P 2031/32* (2013.01); *F01P 2037/02* (2013.01)

(58) Field of Classification Search

CPC ..... F01P 7/165; F01P 2037/02; F01P 5/12
See application file for complete search history.

(56) References Cited

U.S. PATENT DOCUMENTS

| | | | | |
|---|---|---|---|---|
| 2012/0085157 A1* | 4/2012 | Nishigaki | ..... | G01M 15/042 73/114.68 |
| 2014/0093393 A1* | 4/2014 | Araki | ..... | F01P 5/12 417/12 |

FOREIGN PATENT DOCUMENTS

| | | | |
|---|---|---|---|
| CN | 103797224 | A | 5/2014 |
| JP | 57-092055 | U | 6/1982 |
| JP | H10-176534 | A | 6/1998 |
| JP | 2005-163795 | A | 6/2005 |
| JP | 2007-056722 | A | 3/2007 |
| JP | 2009074430 | A | 4/2009 |
| JP | 2011-179421 | A | 9/2011 |
| JP | 2012-219755 | A | 11/2012 |
| JP | 2015-063911 | A | 4/2015 |

* cited by examiner

*Primary Examiner* — Jacob Amick
*Assistant Examiner* — Charles Brauch
(74) *Attorney, Agent, or Firm* — Dinsmore & Shohl LLP

(57) ABSTRACT

A thermostat is diagnosed as open failure when a specified time variation in radiator inflow water temperature from a temperature sensor mounted in a first flow path running through a radiator at a time of starting an electric water pump at a cold start of an engine is equal to or greater than a predetermined variation. In the case of open failure of the thermostat, starting the electric water pump causes cooling water from a cooling water flow path of the engine to be flowed to the first flow path, as well as to a second flow path. The radiator inflow water temperature detected by the temperature sensor mounted in the first flow path is raised by the cooling water from the cooling water flow path of the warmed engine.

2 Claims, 1 Drawing Sheet

COOLING APPARATUS FOR INTERNAL COMBUSTION ENGINE

CROSS-REFERENCE TO RELATED APPLICATIONS

The present disclosure claims priority to Japanese Patent Application No. 2015-168044 filed Aug. 27, 2015, which is incorporated herein by reference in its entirety including specification, drawings and claims.

TECHNICAL FIELD

The present disclosure relates to a cooling apparatus for internal combustion engine and more specifically relates to a cooling apparatus for internal combustion engine that diagnoses a failure of a thermostat included in the cooling apparatus for internal combustion engine.

BACKGROUND ART

A proposed configuration of a cooling apparatus for internal combustion engine diagnoses failure of a thermostat, based on the sensor value from a temperature sensor mounted at an outlet of a cooling water flow path of an internal combustion engine and the sensor value from a temperature sensor mounted on the upstream side of a radiator in a circulation flow path that is arranged to circulate cooling water from the cooling water flow path of the internal combustion engine through the radiator (for example, Patent Literature 1). This apparatus provides accurate diagnosis of failure of the thermostat when the internal combustion engine is driven by combustive operation or when an electric pump configured to circulate the cooling water is in a stopped state even during intermittent stop of the internal combustion engine or during fuel cutting. This apparatus does not provide accurate diagnosis of failure of the thermostat when the electric pump is driven during intermittent stop of the internal combustion engine or during fuel cutting.

CITATION LIST

Patent Literature

PTL 1: JP 2015-063911A

SUMMARY

Technical Problem

At a cold start of the internal combustion engine having the low temperature of cooling water, for the purpose of quickly warming up the internal combustion engine, the cooling apparatus for internal combustion engine described above is likely to stop operation of the electric pump for circulating the cooling water from the beginning of the start of the internal combustion engine until the temperature of the cooling water reaches a certain temperature level. In this case, the cooling water is not circulated but stays. This results in inappropriate diagnosis of failure of the thermostat.

With regard to the cooling apparatus for internal combustion engine, an object of the present disclosure is to ensure appropriate diagnosis of failure of a thermostat at a cold start of an internal combustion engine.

Solution to Problem

In order to achieve the above primary object, the hybrid vehicle of the present disclosure employs the following configuration.

The present disclosure is directed to a cooling apparatus for internal combustion engine. The cooling apparatus includes a radiator; an electric pump that is configured to supply cooling water to an inlet of a cooling water flow path in an internal combustion engine; a first flow path that is arranged to supply the cooling water from the cooling water flow path of the internal combustion engine to the electric pump through the radiator; a second flow path that is arranged to supply the cooling water from the cooling water flow path of the internal combustion engine to the electric pump without passing through the radiator; a thermostat that is configured to prevent the cooling water from being flowed to the first flow path until temperature of the cooling water in the second flow path reaches a first predetermined temperature at a junction of the first flow path and the second flow path; a temperature sensor that is mounted on an upstream side of the radiator in the first flow path to detect temperature of the cooling water in the first flow path; and a controller that is configured to keep the electric pump in a stopped state from beginning of starting the internal combustion engine at a cold start of the internal combustion engine and to start the electric pump when temperature of the cooling water in the cooling water flow path of the internal combustion engine reaches a second predetermined temperature that is lower than the first predetermined temperature. The controller diagnoses that the thermostat has open failure when a variation in the temperature detected by the temperature sensor in a specified time period at a time of starting the electric pump at the cold start of the internal combustion engine is equal to or greater than a predetermined variation.

The cooling apparatus for internal combustion engine of this aspect keeps the electric pump in the stopped state from the beginning of starting the internal combustion engine at a cold start of the internal combustion engine. This causes the cooling water in the cooling water flow path of the internal combustion engine, the first flow path and the second flow path not to flow but to stay. This quickly raises the temperature of the cooling water in the cooling water flow path of the internal combustion engine. The electric pump is started when the temperature of the cooling water in the cooling water flow path of the internal combustion engine reaches the second predetermined temperature that is lower than the first predetermined temperature. In the state that the thermostat is normally operated, the thermostat prevents the cooling water from being flowed to the first flow path. The cooling water from the cooling water flow path of the internal combustion engine is thus flowed to the second flow path, while not being flowed to the first flow path. The temperature detected by the temperature sensor mounted on the upstream side of the radiator in the first flow path accordingly has no significant change. In the case of open failure of the thermostat, on the other hand, the cooling water from the cooling water flow path of the internal combustion engine is flowed to the first flow path, as well as to the second flow path. The temperature detected by the temperature sensor mounted on the upstream side of the radiator in the first flow path is accordingly raised by the cooling water from the cooling water flow path of the warmed internal combustion engine. The thermostat is thus diagnosed to have open failure when the variation of the temperature detected by the temperature sensor mounted on the upstream side of the radiator in the first flow path in the specified time period at the time of starting the electric pump at a cold start of the internal combustion engine is equal to or greater than the predetermined variation. This configuration ensures appropriate diagnosis of failure of the thermostat at a cold start of the internal combustion engine.

The "first predetermined temperature" may be, for example, temperature of 75° C., 80° C. or 85° C. The "second predetermined temperature" may be, for example, temperature of 45° C., 50° C. or 55° C. The "specified time period" may be a time period that meets the following two conditions. The first condition may be that the specified time period is longer than a time period required for a flow of the cooling water from an outlet of the cooling water flow path in the internal combustion engine to the temperature sensor mounted on the upstream side of the radiator in the first flow path by starting the electric pump in a state that the first flow path is opened by the thermostat. The second condition may be that the specified time period is shorter than a time period required for an increase in temperature of the cooling water flowing from the second flow path to the thermostat to the first predetermined temperature after a start of the electric pump at the cold start of the internal combustion engine in a normal state of the thermostat. The "variation in the specified time period" may be, for example, a variation per unit time in the specified time period (obtained by dividing a difference between temperature at the start of the specified time period and temperature at the end of the specified time period by the specified time period), a maximum value of the variation per unit time (time variation) in the specified time period or a variation as a difference between the maximum temperature and the minimum temperature in the specified time period. The "predetermined variation" may be a time variation of temperature such as 1° C./sec, 2° C./sec or 3° C./sec.

DESCRIPTION OF EMBODIMENTS

The following describes some aspects of the present disclosure with reference to embodiments.

Figure 1:
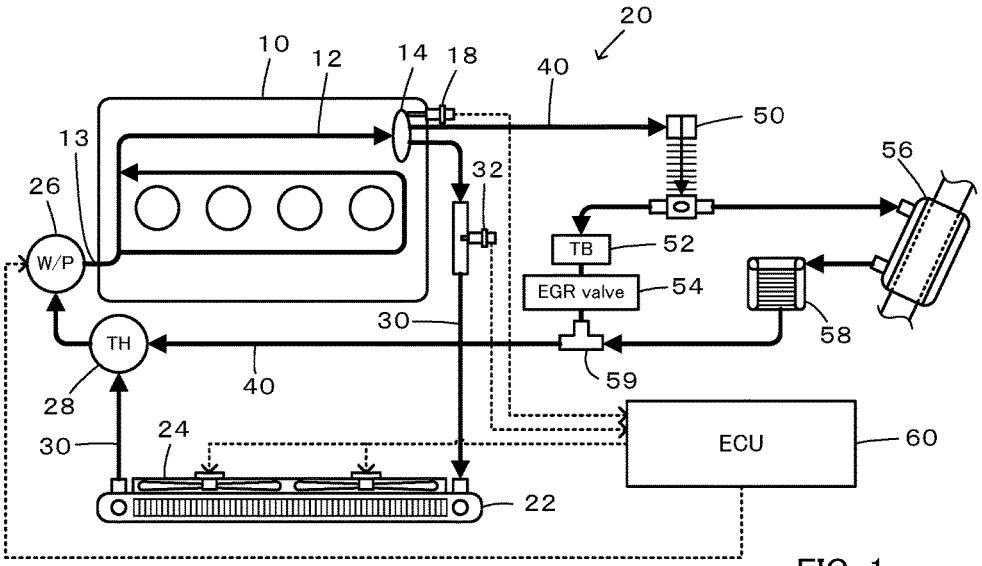
FIG. 1 is a configuration diagram illustrating the schematic configuration of a cooling apparatus for internal combustion engine according to one embodiment of the disclosure.

FIG. 1 is a configuration diagram illustrating the schematic configuration of a cooling apparatus 20 for internal combustion engine according to one embodiment of the present disclosure. The cooling apparatus 20 for internal combustion engine of the embodiment is configured as a cooling apparatus for an engine 10 that is a multi-cylinder internal combustion engine driven with a fuel such as gasoline or light oil. The cooling apparatus 20 for internal combustion engine of the embodiment includes a radiator 22 equipped with a fan 24, an electric water pump 26 configured to supply cooling water to an inlet 13 of a cooling water flow path 12 for cooling down the engine 10, a thermostat 28 and an electronic control unit 60.

A first flow path 30 is connected with an outlet 14 of the cooling water flow path 12 in the engine 10 to circulate the cooling water through the radiator 22 toward the electric water pump 26. A temperature sensor 32 is mounted at a position that is on the upstream side of the radiator 22 (between the outlet 14 and the radiator 22) in the first flow path 30 and is near to the outlet 14 of the cooling water flow path 12 in the engine 10, in order to detect the temperature of the cooling water in the first flow path 30 (radiator inflow water temperature TH).

A second flow path 40 is connected with the outlet 14 of the cooling water flow path 12 in the engine 10 to circulate the cooling water toward the electric water pump 26 without passing through the radiator 22. According to this embodiment, the second flow path 40 includes a flow path arranged to run through an EGR cooler 50 for cooling down the exhaust gas from an exhaust recirculation device (not shown) configured to recirculate the exhaust gas of the internal combustion engine to the intake side, a throttle body 52 and an EGR valve 54 and joins at a junction 59 and a flow path arranged to run through the EGR cooler 50, an exhaust heat recovery unit 56 and a heater core 58 and joins at the junction 59. The exhaust recirculation device, the EGR cooler 50, the throttle body 52, the EGR valve 54, the exhaust heat recovery unit 56 and the heater core 58 are not characteristics of the present disclosure and are not described in detail herein.

The thermostat 28 is mounted at a junction of the first flow path 30 and the second flow path 40 to prevent the cooling water from flowing to the first flow path 30 until the temperature of the cooling water in the second flow path 40 reaches a first predetermined temperature at the junction. The first predetermined temperature may be, for example, temperature of 75° C., 80° C. or 85° C. When the temperature of the cooling water in the second flow path 40 is lower than the first predetermined temperature at the junction, the thermostat 28 closes the first flow path 30 to prevent the cooling water from flowing to the first flow path 30. When the temperature of the cooling water in the second flow path 40 is equal to or higher than the first predetermined temperature at the junction, on the other hand, the thermostat 28 opens the first flow path 30 at an opening position corresponding to the temperature of the cooling water in the second flow path 40, so as to regulate the flow rate of the cooling water flowing in the first flow path 30.

The electronic control unit 60 is configured as a CPU-based microcomputer and includes a ROM, a RAM, a flash memory and input-output ports, although not being specifically illustrated. The electronic control unit 60 receives, via the input port, for example, an engine outlet water temperature Tout from a temperature sensor 18 mounted in the vicinity of the outlet 14 of the cooling water flow path 12 in the engine 10 to detect the temperature of the cooling water in the vicinity of the outlet 14 of the cooling water flow path 12 and the radiator inflow water temperature TH from the temperature sensor 32. The electronic control unit 60 outputs, via the output port, for example, drive control signals to the electric water pump 26 and drive control signals to the fan 24 of the radiator 22.

In the case of a cold start of the engine 10 at the cooling water temperature of −10° C. to −35° C., for the purpose of quickly warming up the engine 10, the cooling apparatus 20 for internal combustion engine of the embodiment having the above configuration keeps the electric water pump 26 in the stopped state until the temperature of the cooling water in the cooling water flow path 12 of the engine 10 reaches a second predetermined temperature. The cooling apparatus 20 for internal combustion engine starts the electric water pump 26 when the temperature of the cooling water in the cooling water flow path 12 reaches the second predetermined temperature. The second predetermined temperature is lower than the first predetermined temperature (for example, 75° C., 80° C. or 85° C.) at which the first flow path 30 is opened by the thermostat 28 and may be, for example, temperature of 45° C., 50° C. or 55° C. The temperature detected by the temperature sensor 18 may be used as the temperature of the cooling water in the cooling water flow path 12 of the engine 10. At a cold start of the engine 10, keeping the electric water pump 26 in the stopped state from the beginning of the start of the engine 10 causes the cooling water not to flow but to stay in the cooling water flow path 12 of the engine 10, the first flow path 30 and the second flow path 40. This quickly raises the temperature of the cooling water in the cooling water flow path 12 of the engine 10. When the temperature of the cooling water in the cooling water flow path 12 of the engine 10 reaches the second predetermined temperature, the electronic control unit 60 starts the electric water pump 26. In the state of normal operation of the thermostat 28, the thermostat 28 keeps the first flow path 30 closed until the temperature of the cooling water in the second flow path 40 flowing into the thermostat 28 reaches the first predetermined temperature. The cooling water is accordingly not flowed to the first flow path 30. When the temperature of the cooling water in the second flow path 40 flowing into the thermostat 28 reaches the first predetermined temperature, the thermostat 28 opens the first flow path 30 at the opening position corresponding to the temperature of the cooling water in the second flow path 40, so as to regulate the flow rate of the cooling water in the first flow path 30.

Figure 2:
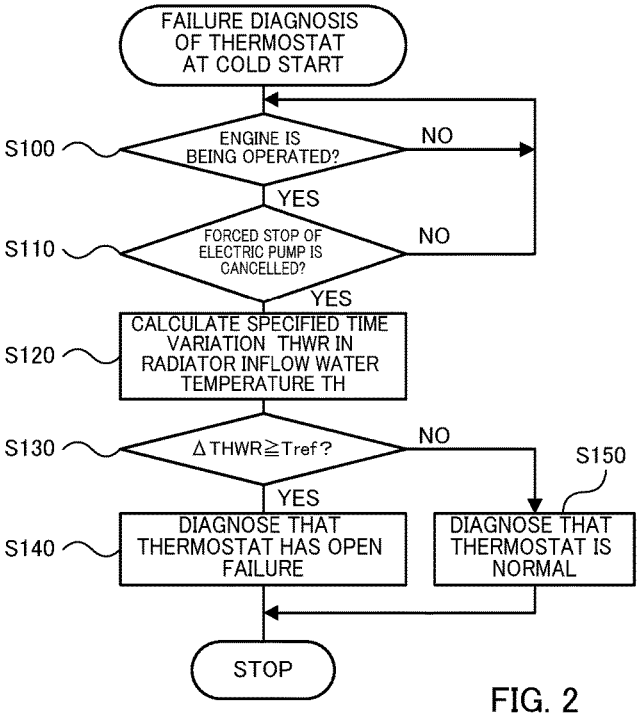
FIG. 2 is a flowchart showing an exemplary processing routine performed for failure diagnosis of the thermostat at a cold start of the engine.

The following describes failure diagnosis of the thermostat 28 at a cold start of the engine 10. FIG. 2 is a flowchart showing an exemplary processing routine performed for failure diagnosis of the thermostat 28 at a cold start of the engine 10. This processing routine is triggered by a cold start of the engine 10.

On the start of failure diagnosis of the thermostat 28 at a cold start of the engine 10, the processing routine first determines whether the engine 10 is being operated (step S100) and subsequently determines whether a forced stop of the electric water pump 26 (keeping the electric water pump 26 in the stopped state) is cancelled (step S110). When the engine 10 is not being operated, i.e., when a start of the engine 10 has not yet been completed, and when the engine 10 is being operated but the electric water pump 26 is forcibly stopped (i.e., kept in the stopped state), the processing routine waits until cancellation of the forced stop of the electric water pump 26. When the forced stop of the electric water pump 26 is cancelled, the electronic control unit 60 starts the electric water pump 26 by the process at the cold start of the engine 10 described above.

When the forced stop of the electric water pump 26 is cancelled, a specified time variation ΔTHWR is calculated as a variation in radiator inflow water temperature TH per unit time in a specified time period, based on the radiator inflow water temperature TH from the temperature sensor 32 mounted in the first flow path 30 (step S120). The processing routine subsequently determines whether the calculated specified time variation ΔTHWR in the radiator inflow water temperature TH is equal to or greater than a predetermined variation Tref (step S130). When the specified time variation ΔTHWR is equal to or greater than the predetermined variation Tref, the processing routine diagnoses that the thermostat 28 has an open failure (step S140) and is then terminated. When the specified time variation ΔTHWR in the radiator inflow water temperature TH is less than the predetermined variation Tref, on the other hand, the processing routine diagnoses that the thermostat 28 is normal (step S150) and is then terminated.

In the normal state of the thermostat 28, even when the electric water pump 26 is started, the first flow path 30 is kept closed by the thermostat 28, so that the cooling water is not flowed to the first flow path 30. Accordingly the radiator inflow water temperature TH detected by the temperature sensor 32 mounted on the upstream side of the radiator 22 in the first flow path 30 has no significant change. In the case of open failure of the thermostat 28, on the other hand, starting the electric water pump 26 causes the cooling water from the cooling water flow path 12 of the engine 10 to be flowed to the first flow path 30, as well as to the second flow path 40. The radiator inflow water temperature TH detected by the temperature sensor 32 mounted on the upstream side of the radiator 22 in the first flow path 30 is raised by the cooling water from the cooling water flow path 12 of the warmed engine 10. The thermostat 28 is accordingly diagnosed to have open failure when the specified time variation ΔTHWR in the radiator inflow water temperature TH detected by the temperature sensor 32 mounted on the upstream side of the radiator 22 in the first flow path 30 at the time of starting the electric water pump 26 at a cold start of the engine 10 is equal to or greater than the predetermined variation Tref.

In order to ensure appropriate diagnosis of open failure of the thermostat 28, the "specified time period" for the calculation of the specified time variation ΔTHWR is determined in advance to meet the following two conditions. The first condition is that the specified time period is to be longer than a time period required for a flow of cooling water from the outlet 14 of the cooling water flow path 12 in the engine 10 to the temperature sensor 32 mounted on the upstream side of the radiator 22 in the first flow path 30 by starting the electric water pump 26 in the state that the first flow path 30 is opened by the thermostat 28. The specified time period of shorter than this required time period provides a small value of near zero as the specified time variation ΔTHWR even in the case of open failure of the thermostat 28. This results in inappropriate diagnosis of open failure of the thermostat 28. The second condition is that the specified time period is to be shorter than a time period required for an increase in the temperature of the cooling water flowing from the second flow path 40 to the thermostat 28 to the first predetermined temperature after a start of the electric water pump 26 at a cold start of the engine 10 in the normal state of the thermostat 28. The specified time period of longer than this required time period causes the temperature of the cooling water flowing from the second flow path 40 to reach the first predetermined temperature, causes the cooling water to be flowed to the first flow path 30 by the operation of the thermostat 28 and accordingly provides a large value as the specified time variation ΔTHWR even in the normal state of the thermostat 28. This results in inappropriate diagnosis of open failure of the thermostat 28. The "specified time variation ΔTHWR" denotes the variation in the radiator inflow water temperature TH per unit time in the specified time period and can thus be calculated by dividing a difference between the radiator inflow water temperature TH detected at the start of the specified time period and the radiator inflow water temperature TH detected at the end of the specified time period by the specified time period. The predetermined variation Tref may be, for example, 1° C./sec, 2° C./sec or 3° C./sec.

The cooling apparatus 20 for internal combustion engine of the embodiment described above calculates the specified time variation ΔTHWR in the radiator inflow water temperature TH from the temperature sensor 32 mounted in the first flow path 30 running through the radiator 22 at the time of starting the electric water pump 26 at a cold start of the engine 10. In the case of open failure of the thermostat 28, starting the electric water pump 26 causes the cooling water from the cooling water flow path 12 of the engine 10 to be flowed to the first flow path 30, as well as to the second flow path 40. The radiator inflow water temperature TH detected by the temperature sensor 32 mounted in the first flow path 30 is raised by the cooling water from the cooling water flow path 12 of the warmed engine 10. The thermostat 28 is accordingly diagnosed to have open failure when the calculated specified time variation ΔTHWR is equal to or greater than the predetermined variation Tref. This configuration ensures appropriate diagnosis of failure of the thermostat 28 even at a cold start of the engine 10.

The cooling apparatus 20 for internal combustion engine of the embodiment diagnoses that the thermostat 28 has open failure when the specified time variation ΔTHWR calculated by dividing the difference between the radiator inflow water temperature TH detected at the start of the specified time period and the radiator inflow temperature TH detected at the end of the specified time period by the specified time period is equal to or greater than the predetermined variation Tref. According to a modification, the thermostat 28 may be diagnosed to have open failure when a maximum time variation obtained as a maximum value of the variation in the radiator inflow water temperature TH per unit time (time variation) in the specified time period is equal to or greater than a predetermined variation. According to another modification, the thermostat 28 may be diagnosed to have open failure when a temperature variation as a difference between the maximum temperature and the minimum temperature of the radiator inflow water temperature TH in the specified time period is equal to or greater than a predetermined variation.

The following describes the correspondence relationship between the primary components of the embodiment and the primary components of the present disclosure described in Summary. The radiator 22 of the embodiment corresponds to the "radiator"; the electric water pump 26 corresponds to the "electric pump"; the first flow path 30 corresponds to the "first flow path", the second flow path 40 corresponds to the "second flow path"; the thermostat 28 corresponds to the "thermostat"; the temperature sensor 32 corresponds to the "temperature sensor"; and the electronic control unit 60 corresponds to the "controller".

The correspondence relationship between the primary components of the embodiment and the primary components of the present disclosure, regarding which the problem is described in Summary, should not be considered to limit the components of the present disclosure, regarding which the problem is described in Summary, since the embodiment is only illustrative to specifically describes the aspects of the present disclosure, regarding which the problem is described in Summary. In other words, the present disclosure, regarding which the problem is described in Summary, should be interpreted on the basis of the description in the Summary, and the embodiment is only a specific example of the present disclosure, regarding which the problem is described in Summary.

The aspect of the present disclosure is described above with reference to the embodiment. The present disclosure is, however, not limited to the above embodiment but various modifications and variations may be made to the embodiment without departing from the scope of the present disclosure.

INDUSTRIAL APPLICABILITY

The technique of the present disclosure is preferably applicable to the manufacturing industries of cooling apparatus for internal combustion engine.

The invention claimed is:

1. A cooling apparatus for internal combustion engine, comprising:

a radiator;

an electric pump that is configured to supply cooling water to an inlet of a cooling water flow path in an internal combustion engine;

a first flow path that is arranged to supply the cooling water from the cooling water flow path of the internal combustion engine to the electric pump through the radiator;

a second flow path that is arranged to supply the cooling water from the cooling water flow path of the internal combustion engine to the electric pump without passing through the radiator;

a thermostat that is configured to prevent the cooling water from being flowed to the first flow path until temperature of the cooling water in the second flow path reaches a first predetermined temperature at a junction of the first flow path and the second flow path;

a temperature sensor that is mounted on an upstream side of the radiator in the first flow path to detect temperature of the cooling water in the first flow path; and an electronic control unit that is configured to keep the electric pump in a stopped state from beginning of starting the internal combustion engine at a cold start of the internal combustion engine and to start the electric pump when temperature of the cooling water in the cooling water flow path of the internal combustion engine reaches a second predetermined temperature that is lower than the first predetermined temperature, wherein the electronic control unit diagnoses that the thermostat has open failure when a difference between the temperature detected by the temperature sensor at a start of a specified time period at a time of starting the electric pump at the cold start of the internal combustion engine and the temperature detected by the temperature sensor at an end of the specified time period is equal to or greater than a predetermined variation.

2. The cooling apparatus for internal combustion engine according to claim 1, wherein the specified time period is longer than a time period required for a flow of the cooling water from an outlet of the cooling water flow path in the internal combustion engine to the temperature sensor mounted on the upstream side of the radiator in the first flow path by starting the electric pump in a state that the first flow path is opened by the thermostat, and wherein the specified time period is shorter than a time period required for an increase in temperature of the cooling water flowing from the second flow path to the thermostat to the first predetermined temperature after a start of the electric pump at the cold start of the internal combustion engine in a normal state of the thermostat.

* * * * *